US005714923A

United States Patent [19]

Shea et al.

[11] Patent Number: 5,714,923

[45] Date of Patent: Feb. 3, 1998

[54] HIGH VOLTAGE CURRENT LIMITING FUSE WITH IMPROVED LOW OVERCURRENT INTERRUPTION PERFORMANCE

[75] Inventors: John Joseph Shea; William Kingston Hanna, both of Pittsburgh; William Ralph Crooks, deceased, late of Pittsburgh, all of Pa.; Valerie J. Crooks, executrix, Atlanta, Ga.

[73] Assignee: Eaton Corporation, Cleveland, Ohio

[21] Appl. No.: 651,996

[22] Filed: May 23, 1996

[51] Int. Cl.[6] ..... H01H 85/04

[52] U.S. Cl. ..... 337/159; 337/142; 337/229; 337/416

[58] Field of Search ..... 337/142, 158, 337/159, 161, 166, 186, 227, 228, 229, 273, 280, 293, 401, 404, 405, 406; 361/103, 104

[56] References Cited

U.S. PATENT DOCUMENTS

| | | | |
|---|---|---|---|
| 2,143,038 | 1/1939 | Smith, Jr. | 200/120 |
| 2,294,767 | 9/1942 | Williams | 200/120 |
| 3,287,524 | 11/1966 | Huber et al. | 200/120 |
| 3,925,745 | 12/1975 | Blewitt | 337/279 |
| 4,099,153 | 7/1978 | Cameron | 337/158 |
| 4,166,266 | 8/1979 | Kozacka et al. | 337/158 |
| 4,339,742 | 7/1982 | Leach et al. | 337/279 |
| 4,357,588 | 11/1982 | Leach et al. | 337/160 |
| 4,638,283 | 1/1987 | Frind et al. | 337/162 |
| 5,359,174 | 10/1994 | Smith et al. | 200/144 C |
| 5,406,245 | 4/1995 | Smith et al. | 337/273 |

*Primary Examiner*—Leo P. Picard
*Assistant Examiner*—Jayprakash N. Gandhi
*Attorney, Agent, or Firm*—Martin J. Moran

[57] ABSTRACT

A high voltage current limiting fuse has improved low fault current interruption due to an end-sealed sleeve separating a fusible length from pulverulent sand in a casing of the fuse while permitting venting of gas and vaporized metal plasma due to melting and arcing at the fusible length. The fuse can have one or more fusible elements, of which at least one, preferably each one, is surrounded along at least a selected portion along its length by a polytetrafluoroethylene polymer, fluoroethylene polymer, or derivatives thereof, which can be heat shrinkable or not. The sleeve is sealed so as to allow escape of gases upon arcing from the sleeve but to prevent pulverulent materials from penetrating within the sleeve. The sleeve seals are either melted and crimped together with the fusible element, heat shrunk down onto the fusible element, or taped over the fusible element so as to leave a gap small enough to exclude the pulverulent material while venting gas and plasma. A high voltage current limiting fuse has improved low fault current interruption also due to inclusion of a separate low fault current compartment with at least one gas-venting end-sealed sleeve separating a fusible length from either pulverulent sand or air in a casing of the fuse. The sleeve in the low fault current compartment can include a plurality of spaced passageways for inclusion of multiple fusible elements. The sleeve portions of the fusible elements in the low fault current compartment can also be positioned in channels in a block of insulative material placed in this compartment.

41 Claims, 6 Drawing Sheets

HIGH VOLTAGE CURRENT LIMITING FUSE WITH IMPROVED LOW OVERCURRENT INTERRUPTION PERFORMANCE

FIELD OF THE INVENTION

The invention relates to fusible circuit interruption devices, and more particularly to a high voltage current limiting fuse having improved interruption performance.

BACKGROUND OF THE INVENTION

Interruption of a high voltage circuit advantageously requires a current interruption device that rapidly brings the current to zero upon the occurrence of a line fault. A "high" voltage fuse as generally considered herein is of a type employed in electrical power distribution circuits typically carrying voltages in excess of 1,000 volts, for example, 5.5 to 15.5 kV. Line faults at these high energy levels can cause extensive damage to circuit components and devices connected to the circuit, or to conductors and various other portions of the electrical energy distribution system. To minimize potential damage, fuses are employed with the intent to interrupt current flow quickly, following the onset of fault conditions involving high current loading, such as a short circuit or overload faults.

A typical high voltage current limiting fuse includes: a hollow tubular casing of an electrically insulating material, such as a tubular glass reinforced epoxy casing; a pair of electrical end terminals, such as contact ferrules, closing the opposite ends of the tubular casing; at least one fusible element, including reduced cross-sectional arcing regions along its length, electrically coupled between the end terminals, such as silver ribbon or wire, or multiple fusible elements, e.g., parallel-connected spaced-apart silver conductors, electrically connected to the end terminals and optionally wrapped within the tubular casing about a supportive core of electrically insulating material; pulverulent arc-quenching flier material of high dielectric strength, such as silica, sand or quartz, occupying the voids in the casing and enveloping the fusible element(s); and, an optional gas-evolving material, such as melamine, in proximity with the fusible element(s) to assist in cooling, quenching and otherwise limiting the electric arc that is struck when the fusible element melts and thereby breaks the connection between the terminals. The coreless high voltage current limiting fuse designs are in common practice today.

When the high voltage fuse is subjected to an applied current that exceeds the rated current-carrying capability of the fusible element for a predetermined duration, resistive heating raises the temperature of the fusible element sufficiently to melt it. Tin ("M-effect" material) can be disposed at one or more longitudinally restricted regions along each fusible silver conductor to define relatively lower melting temperature region(s), whereby gaps open at these regions when the fusible element melts.

An electric arc is struck across the gap formed when melting breaks the continuity of the conductive path between the terminals. Therefore, one or a plurality of series-connected arcs are formed in the fuse, each having a given resistance. Current through the fuse is finally interrupted when the sum of the voltages across the individual arcs exceeds the voltage applied to the fuse, stopping the flow of current.

Thus, the current limiting effect is obtained initially by introducing arc resistance in series with the circuit. Over a preferably-short period of time, the arcs that are formed in the gaps of the fusible elements are extinguished as the gaps enlarge and the arc-carrying ions of the melted and vaporized fusible metal migrate into spaces between the grains of sand or other pulverulent, on which the metal condenses with heat transfer cooling, and is constrained where it is no longer available for current conduction. This is known as burn-back of the fusible material. Gas-evolving materials can assist in quenching the arc by evolving a deionizing gas to increase arc resistance, to reduce conduction through gases that are ionized by the arc and to cool the arc as well.

Resistive heating is proportional to the square of the current and will melt the fusible element if the heating exceeds the capacity of the fuse to dissipate heat for a long enough time. Long term excess current at a relatively lower level can melt the fusible element, just as a short term higher level current can melt it. However, conventional sand-filled high voltage fuses are subject to problems when interrupting a circuit at relatively lower current levels. A low overcurrent non-interruption zone exists above the continuous current rating of the fuse and below its minimum interrupting current. This region will vary from fuse to fuse. In this non-interruption region, a relatively lower overcurrent may not initiate rapid enough fusing and burn-back of the fusible element in order to interrupt the current dependably and promptly. Current in this region is not high enough to burn-back the fusible element rapidly and to move the fusible metal out of the current path, and into the pulverulent arc-quenching sand. Slow bum-back produces higher temperatures in the sand enveloping the fusible element and poor dielectric recovery. At the hot arcing regions the pulverulent sand is melted and fused together, forming "fulgurites" which have greatly reduced dielectric strength. At high temperatures characteristic of an arc, the fulgurites provide conductive paths bridging the gap in the fusible element, and can remain conductive enough to allow restriking of the are and delaying or preventing circuit interruption.

Similarly, if a plurality of fusible regions are provided along the fusible element, a relatively low overcurrent (e.g., in the non-interruption region) may melt the fusible element at only one location whereas a high overcurrent would melt several or all of the fusible regions. If only a single gap and only a single arc is created in response to the overcurrent condition, less are resistance is inserted into the conductive path. For the fuse to successfully interrupt the current with a single are, the are length (and therefore the resistance) must be increased by further widening of the gap at the arc. Developing a long arc length in a short time may not be feasible, especially considering that the are can elongate only slowly when the current density is low.

For the foregoing reasons, conventional sand-filled high voltage current-limiting fuses are generally quite successful in rapidly interrupting very high current faults such as short circuit currents and similar major problems. However, these fuses do not perform as well in interrupting lower fault currents such as long duration overload currents, due in part to the relatively slow growth of the are length, i.e. , slow bum-back, and the poor dielectric recovery of the heated sand which bridges the gap. Therefore, a current range exists in these fuses for which the fuse may not clear the circuit. This non-interrupting range occurs between the continuous steady-state rating of the fuse and its minimum interrupting current.

What is needed is a high voltage current limiting fuse which has improved low current, i.e., overload, interruption characteristics. Efforts have been made in the past to improve the low current interruption performance of high voltage current limiting fuses. U.S. Pat. No. 4,638,283 (Frind et al.) uses exothermic materials positioned adjacent to the fusible element and a triggering circuit for initiating exothermic reactions to establish multiple breaks in a high voltage fusible element in order to facilitate low overcurrent interruption. U.S. Pat. No. 4,357,588 (Leach et al.) uses fusible elements with portions having reduced cross-sectional areas for causing rupturing in these areas at a desired fusible time-current characteristic. U.S. Pat. No. 2,294,767 (Williams) uses mechanical means of enlarging a gap to assist low current interruption. U.S. Pat. No. 2,143,038 (Smith) uses boric acid in part of the fuse to provide low current interruption. All of these approaches have drawbacks in that they have complex structures, require unduly high interruption energies and/or have unduly long arcing and burn-back times.

Another approach for achieving low current interruption is described in U.S. Pat. No. 3,287,524 (Huber et al.). In Huber et al., a sleeve of polytetrafluoroethylene (also known as PTFE or Teflon®), is placed along the length of the fusible element, particularly symmetrically spaced around the Metcalf-effect ("M-effect") material on the fusible element, such as a tin spot, to form a chamber around the fusible element. The sleeve arrangement is considered to improve the low current circuit interruption performance of the high voltage fuse. The present invention is directed to improving this technique of providing PTFE sleeve arrangements around fusible element(s) in order to increase the burn-back rate of the fusible element and increase the dielectric recovery at low current fault conditions.

The present invention, thus, provides a "full-range" high voltage current limiting fuse that can interrupt low overcurrents at around the continuous steady-state rating of the fuse through substantial elimination of the low overcurrent non-interruption zone which is usually present in conventional high voltage current limiting fuses.

SUMMARY OF THE INVENTION

It is an object of the invention to provide a high voltage current limiting fuse with improved low fault current interruption characteristics.

It is another object of the invention to provide a high voltage current limiting fuse with increased burn-back rates of the fusible element and increased dielectric recovery, particularly when interrupting a circuit at relatively low fault current conditions.

It is a further object of the invention to provide a high voltage current limiting fuse with an improved sleeved arrangement around the fusible element for improved low fault current interruption capabilities.

It is a further object of the invention to provide an improved high voltage current limiting fuse using the conventional sand-filled fuse design, since the sleeve is placed around the existing fusible elements.

It is still another object of the invention to provide a high voltage current limiting fuse using a new two compartment sand-filled fuse design with improved low fault current interruption characteristics, where one compartment is a short circuit section based on the conventional sand-filled fuse design and where the second compartment connected in series with the first is a low overcurrent compartment with an improved sleeved arrangement around the fusible element for low fault current interruption capabilities and ease of assembly.

In one aspect, the invention resides in a high voltage current limiting fuse based on a conventional sand-filled fuse design having a casing of electrically insulative material with electrically conductive terminals closing each of the opposite ends and a fusible element electrically coupled between the terminals. A sleeve of electrical insulating material, preferably PTFE, is generally spaced around the fusible element and has gas-permeable but pulverulent-tight seals closing the opposite ends of the sleeve. The seals are formed, for example, by melting and crimping opposite ends of the sleeve together with the fusible element, by heat shrinking each of the opposite ends of the sleeve down onto the fusible element or by taping the ends of the sleeve to the fusible element. The pulverulent arc-quenching filler surrounds the fusible element, outside the sleeve, such that the sleeve allows gas to pass outwardly from the fusible element while reducing fulgurite formation, heating of the pulverulent filler and other adverse aspects otherwise characterizing low temperature circuit interruption.

In another aspect, the invention resides in a high voltage current limiting fuse based on a new sand-filled fuse design having a casing of electrically insulative material with electrically conductive terminals closing each of the opposite ends, and an electrically conductive partition terminal disposed within the casing, dividing the casing into two series-connected sections, a short circuit section and a low overcurrent section. The short circuit section contains one or more fusible elements electrically connected between one end terminal and the partition terminal and submersed in pulverulent arc-quenching filler. The low overcurrent section contains one or more fusible elements electrically connected between the other end terminal and the partition terminal. In the low overcurrent section, a sleeve of electrical insulating material, preferably PTFE, is generally spaced around each fusible element and has gas-permeable but pulverulent-tight seals closing the opposite ends of the sleeve. The seals are formed through the same methods as mentioned above. The low overcurrent fusible element is also submersed in pulverulent arc-quenching filler that surrounds the fusible element, outside the sleeve, such that the sleeve allows gas to pass outwardly from the fusible element while reducing fulgurite formation, heating of the pulverulent flier and other adverse aspects otherwise characterizing low temperature circuit interruption. The sleeve can have a plurality of internal spaced passageways for receiving multiple fusible elements. Alternatively, the low overcurrent section can contain a block of insulative material, preferably PTFE, to replace part or all of the pulverulent arc-quenching filler in this section, the block having a plurality of spaced channels for receiving a fusible element surrounded by a sleeve in each channel.

BRIEF DESCRIPTION OF THE DRAWINGS

There are shown in the drawings certain exemplary embodiments of the invention as presently preferred. It should be understood that the invention is not limited to the embodiments disclosed and is capable of variation within the scope of the appended claims. In the drawings.

DETAILED DESCRIPTION OF THE PREFERRED EMBODIMENTS OF THE INVENTION

The invention provides an improved high voltage current limiting fuse with improved low current interruption characteristics. Low current interruption performance is improved in part by increased bum-back rates of the fusible element(s), better dielectric recovery of the fuse as a result of exclusion of the pulverulent sand in the arcing regions, and other advantages which will be apparent from the preferred embodiments discussed herein.

Figure 1:
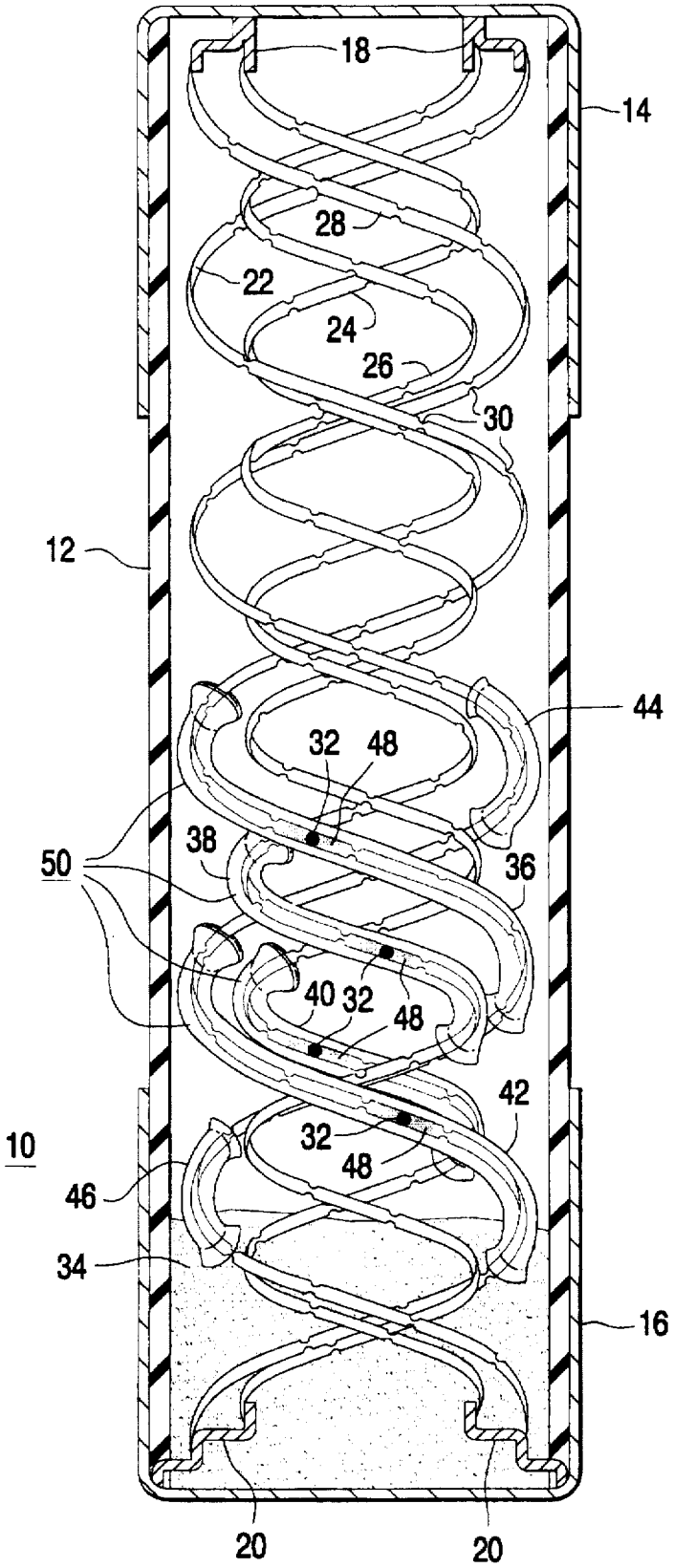
FIG. 1 is a side elevation, partly-sectional view of a first embodiment of a high voltage fuse in accordance with the present invention.

Referring to FIG. 1, a first embodiment of a high voltage current limiting fuse 10, which is based on a conventional sand-filled fuse design but has improved low overcurrent interruption performance, includes a tubular casing 12 of insulative material, for example glass reinforced epoxy resin, forming an outer chamber. Two conductive end terminals or ferrules 14, 16, for example copper ferrules, are attached in a suitable manner onto the tubular casing 12 at its opposite ends, closing each of the opposite ends. The end ferrules 14, 16 provide a means for electrically connecting the fuse into an external circuit (not shown) to be protected from overcurrent conditions. Conductive arms 18, 20 are electrically connected to respective opposite end terminals 14, 16 and extend inside the tubular casing 12. The conductive arms 18, 20 are further electrically connected to conductive fusible elements 22, 24, 26, 28, completing an electrical connection of the end terminals. The fusible elements comprise, for example, a relatively low resistivity and low specific heat metal, such as silver, aluminum, cadmium, copper, tin, zinc or other suitable metal or alloy of metals. Silver is a preferred material for the fusible elements. The fusible elements 22, 24, 26, 28 as shown have a rectangular ribbon-type shape, but they may also take other forms as known in the art, such as a cylindrical wire-type shape. Although not shown in detail in FIG. 1 for the sake of simplicity, the fusible elements 22, 24, 26, 28 are electrically connected to the conductive arms 18, 20 and the conductive arms are electrically connected to the ferrules 14, 16 both in a suitable manner known in the art, such as welding, soldering or molding.

A single fusible element may be employed as is known in the art, however the embodiment shown in FIG. 1 has multiple fusible elements 22, 24, 26, 28 extending between the end terminals 14, 16 and electrically connected thereto through the conductive arms 18, 20. Thus the fusible elements are electrically connected in parallel with each other. As shown, the fusible elements 22, 24, 26 and 28 are spirally or helically wound between the end terminals 14, 16 in a spaced-apart relationship to each other for lower resistance as is well known in the art. A core (not shown) of insulative material, for example a cylinder or tube of vitrified ceramic, may be placed centrally or otherwise to support the fusible elements, e.g., the fusible elements being wound on the core, as is known in the art. However, as shown in FIG. 1, the fuse preferably is a coreless structure as is also well known in the art.

As shown in FIG. 1, each of the fusible elements 22, 24, 26, 28 has a plurality of reduced cross-sectional areas formed between notches 30 in opposite lateral sides of the fusible elements. Regions of reduced cross-sectional area can be formed using other shapes as well, as is known in the art, for example by providing successive perforations through the middle portion of the fusible elements, instead of side notches. The regions of reduced cross section are provided so as to provide spaced points of increased current density when a current is passed longitudinally through the fusible element, causing locally increased heating.

The fusible elements and the reduced cross section regions are dimensioned so that at a given level of current through the fusible elements, heating at the reduced cross section regions is sufficient to melt the material of the fusible elements. At least one gap and preferably a plurality of gaps are thereby formed along the fusible elements and series-related arcs are formed at corresponding locations along the length of the fusible elements, vaporizing the melted metal.

To assist in initiating fuse operation at low overload currents, each of the fusible elements 22, 24, 26, 28 preferably has at least one Metcalf-effect ("M-effect") overlay 32. This comprises a coating or section of a low melting point metal or alloy which will form a lower melting point eutectic alloy with the fusible elements, to initiate melting and arcing in this region as is known in the art. The M-effect material can be tin or a tin alloy, or indium. An M-effect overlay 32 can be disposed adjacent to each of the notches 30.

When the fusible elements 22, 24, 26, 28 are heated, e.g., by a low overload current that persists for a predetermined duration, the overlays 32 begin to melt and to alloy with the underlying material of the fusible elements 22, 24, 26, 28, thereby forming a eutectic. This has the effect of lowering the effective melting point of the fusible elements as well as increasing the electrical resistance of the fusible element at locations where alloying takes place. The reduced melting point and increased resistance, in turn, accelerates melting and vaporization of fusible elements at the overlays 32, reducing the time required to form associated arcs at these overlay locations during low overload current conditions.

The tubular casing 12 is filled with a pulverulent arc-quenching material 34, for example, finely divided sand, quartz, mica, glass, asbestos or other suitable materials, although sand or quartz is most preferred. The arc-quenching pulverulent filler is preferably provided in a free-flowing form, such as spherical granules, for example Granusil®, sold by Unimin Corporation, to allow the filler to flow uniformly and thereby fill the tubular casing around the fusible elements. For the sake of clarity of FIG. 1, the pulverulent arc-quenching filler 34 is shown as only partially filling the tubular casing 12, although in actuality it preferably fills all voids in the entire casing. The arc-quenching flier 34 cools the products of arcing and assists in extinguishing the arcs that are established when the fusible element melts and burns back.

For a detailed description of conventional sand-filled high voltage fuse structures and materials of construction, reference can be made to U.S. Pat. Nos. 3,925,745 (Blewitt), 4,099,153 (Cameron), 4,166,266 (Kozacka), 4,339,742 (Leach, et al.), 4,638,283 (Frind, et al.), and 5,406,245 (Smith, et al.), the disclosures of which are hereby incorporated in their entireties.

As discussed above, a conventional sand-filled high voltage fuse may be ineffective to interrupt a low overload current in a high voltage circuit or may not interrupt the current promptly, due to slow or limited burn-back, conduction through fulgurites and the like. More particularly a low overload current, i.e. , a current level higher than the continuous current rating of the fuse but lower than the high current interruption level, is not high enough to burn-back the silver fusible elements enveloped by the sand filler quickly and/or extensively. Slow burn-back leads to higher temperatures in the molten sand surrounding the fusible element, with consequent reduction of dielectric strength, conduction through molten sand in the arcing region along a path of lower resistance bridging the arc gap, and potential restriking of the arc across the gap. The molten sand (or fulgurite) bridging the fusible element gap can remain sufficiently conductive to prevent complete circuit interruption. Slow burn-back can lead to extremely high fulgurite temperatures, which also can cause failed interruption.

To combat these problems optimally, according to the invention an improved insulative polymeric sleeved arrangement is placed around the fusible element along its length at selected arcing regions to improve low fault current interruption characteristics. This new sleeve and fusible element assembly is especially an improvement over the high voltage fuses with sleeve and fusible element assemblies disclosed in U.S. Pat. No. 3,287,524 (Huber et al.), which disclosure is also hereby incorporated by reference in its entirety. As further shown in FIG. 1, according to the invention insulative sleeves 36, 38, 40, 42, which are more fully described below, are positioned around selected regions of the fusible elements 22, 24, 26, 28, respectively. Each forms a chamber along the respective fusible element, which substantially seals out the pulverulent material. Preferably, sleeves 36, 38, 40, 42 are placed along the fusible elements symmetrically around M-effect overlay regions 32, namely around arcing regions. Multiple sleeves can be positioned along a single fusible element around multiple arcing regions, for example at the M-effect points. To prevent turn-to-turn voltage breakdown between adjacent turns of the helically wound fusible elements, end sleeves 44, 46 may be placed adjacent the outer sleeves 36, 42, respectively. Furthermore, a ceramic tape or other insulative material (not shown) may be provided around the outside periphery of the sleeves for added thermal insulation.

Sleeves 36, 38, 40, 42 are electrically insulative and gas permeable, and exclude the sand pulverulent from contact or intimate association with the fusible elements adjacent the arcing regions. The sleeves preferably comprise either polytetrafluoroethylene (PTFE) polymer (known as Teflon®), fluoroethylene polymer (FEP) (also known as Teflon®), copolymers thereof, or a similar suitable material. Reference can be made to Kirk Othmer, Concise Encyclopedia of Chemical Technology, John Wiley & Sons, Inc., 1985, pp. 512516 and The Merck Index, Merck & Co., Inc. 11 edition, 1989, pp. 1207–1208, monograph no. 7560, for a more detailed discussion of polytetrafluoroethylene (PTFE) polymers and other fluoroethylene (FEP) polymers and derivatives. The sleeve material may be annular in transverse cross section, having a circular, square, or rectangular geometry depending on the cross-sectional geometry of the fusible element. Circular tubing on a metal ribbon of rectangular cross section is shown in the drawings, since such robing is readily available, although rectangular tubing may be preferred to better conform to the ribbon element.

The sleeve material should meet the following selection criteria, which are met by PTFE and FEP, in particular: no substantial structural degradation at temperatures up to about 150° C. for over about 20 years; ability to withstand temperatures from about 150° C. to 300° C. for up to about 6 hours; ability to withstand temperatures from about 300° C. to 330° C. for up to about 5 minutes; ability to withstand venting of hot metal plasma without adsorption of plasma; low coefficient of friction; high dielectric strength; relatively non-carbonizing; easy to handle, apply and seal; and, low cost.

Heat shrinkable or non-heat shrinkable Teflon® polymers (PTFEs and FEPs) can be used for the sleeve material, either of which can be obtained, for example, from Zeus, Inc. of Orangeburg, South Carolina. Heat shrink Teflon® polymers advantageously are easier and faster to assemble and to seal at the ends. However, heat shrink Teflon® polymers have been found in certain instances by the inventors to assume a gel-state just after the fusible element melted. Non-heat shrink Teflon® polymers tend to remain substantially intact and undegraded after melting, arcing and clearing of the fusible element. In the invention, from arcing to clearing, the Teflon® (PTFE or FEP, non-heat shrink or heat shrink) sleeve or other sleeve material is designed to remain substantially intact in structure. Other sleeve materials possibly suitable for use includes various classes of other high performance polymers such as imids, amines, epoxies, polyetheretherketones, and polyimides.

According to the embodiment shown, gas-evolving material 48 is disposed in close proximity to the fusible element inside the sleeves 36, 38, 40, 42 prior to sealing. The gas-evolving material 48, as known in the art, aids in extinction of the arc by rapidly evolving a deionizing gas which, on one hand, reduces conduction through gases ionized by the arc and, on the other hand, cools the arc in order to bring the current through the fusible element to a zero value. The gas-evolving material 48 can include inorganic materials, for example hydrated alumina, calcium carbonate, boric acid, magnesium hydroxide or other suitable material, and organic materials, for example, melamine, melamine cyanurate, guanidine, guanidine acetate, guanidine carbonate, guanine, hydantoin, allantoin, urea, urazole, urea phosphate, and salts, derivatives or combinations thereof, or other suitable materials. The methods of incorporating the gas-evolving material 48 inside the sleeves include painting the fusible element, providing a dry powder in proximity of the fusible element, compounding into a self-supporting polymer matrix attached to the fusible element, or compounding into the sleeve polymer during manufacture of the sleeve.

The gas-evolving material 48 is provided in a suitable amount to aid in quenching the arc without pressure build-up sufficient to rupture the sleeves. Preferably the gas-evolving material upon decomposition is formulated to have non-carbonizing and therefore non-track forming properties. Once an electric arc is formed between the ends of unmelted portions of the fusible element spaced by a melted portion, the arc will burn sufficiently close to the gas-evolving material to quickly heat the material to cause deionizing gases to be released therefrom. These gases assist in cooling and extinguishing the arc in order to bring the current through the fusible element to a zero value. For a detailed description of gas-evolving materials and methods of application, reference can be made to U.S. Pats. Nos. 5,359,174 (Smith, et al.) and 5,406,245 (Smith, et al.), the disclosures of which are hereby incorporated in their entireties.

An optional PTFE powder (not shown) can be incorporated inside the passageways of the sleeve in the gap surrounding the fusible elements. The PTFE powder upon arcing of the fusible element vaporizes and evolves fluorine gas. The fluorine gas is provided to aid in deionizing the hot plasma in the sleeved enclosure during fusing and to obstruct the arc path. Fluorine gas is an electronegative gas which will capture electrons present in the metal plasma, thereby deionizing the gap. This effect is similar to that produced by a gas-evolving material mention above.

Figure 2:
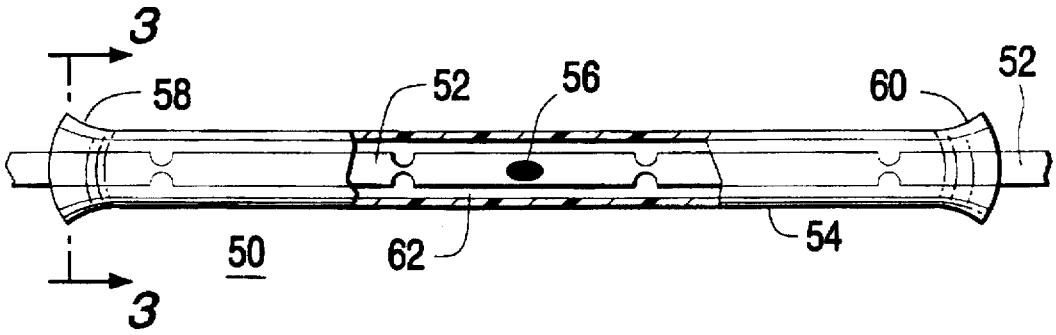
FIG. 2 is a partial view of one embodiment of a sleeved fusible element assembly in accordance with the present invention.
Figure 3:
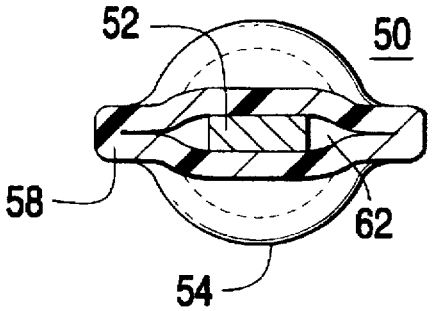
FIG. 3 is a cross-sectional view of the sleeved fusible element assembly of FIG. 2, taken along line 3—3 of FIG. 2.

Referring now to the embodiment of FIGS. 2 and 3, a more detailed illustration of a single fusible element and sleeve assembly 50 is shown, which assembly is also generally shown in the fuse 10 of FIG. 1 around the multiple fusible elements 22, 24, 26, 28. The fusible element and sleeve assembly 50 includes a preferably-silver fusible element 52 generally surrounded, preferably in a spaced-apart relationship, at a selected portion along its length by a non-heat shrinkable Teflon® (PTFE or FEP) sleeve 54, although a heat shrink Teflon® (PTFE or FEP) sleeve may also be used. This forms a sleeved section or enclosure about the fusible element, preferably symmetrically about an M-effect tin overlay 56 disposed on the fusible element. The sleeve length depends upon the voltage rating of the fuse. In general, the higher the voltage rating of the fuse, the longer the sleeve. The fusible element and sleeve assembly 50 is electrically connected to and placed within a glass reinforced epoxy tubular casing 12 closed by end terminals 14, 16, and is also submersed in a pulverulent arc-quenching filler sand 34 (See, FIG. 1). The pulverulent arc-quenching flier sand, however, is excluded by sleeve 54 from the fusible element 52. End seals 58, 60 are provided so that together with the fusible element 52 substantially close the opposite ends of the sleeve 54 to exclude the pulverulent filler from contact with the fusible element in the sleeve region.

The exclusion of the sand or other pulverulent arc-quenching filler from within the sleeve enclosure aids in attainment of high dielectric recovery, especially over a short gap in the fusible element. Fulgurites are precluded from forming in this sleeve region and bridging the gap, thus increasing the dielectric recovery. The end seals 58, 60 are porous or otherwise gas permeable in order to allow hot gases, such as the hot silver metal vapor plasma, to vent out of the sleeve 54 into the arc-quenching sand. The end seals in this manner control the mount of venting and the direction or location of released hot metal vapor plasma. By allowing the hot gases to vent out of the gas-permeable sleeve ends, gas flows longitudinally outward along the fusible element 52, which in turn aids in the rapid burn-back of the fusible element due to convective energy being transferred to the fused material in the sleeved enclosure. The gas-permeable end seals 58, 60 relieve gas pressure and prevent rupture of the sleeve 54. High pressures in the sleeve 54 are desired for increased breakdown strength. However, if pressures generated by the arc are not quickly relieved, the sleeve 54 may rupture and preclude circuit interruption.

The gas-permeable, partially closed, end seals 58, 60 are preferably formed by sufficiently heating the non-heat shrink Teflon® (PTFE or FEP) tube sleeve 54 at its respective opposite ends to a moldable state and then pressing or crimping the ends together with the fusible element 52 in the tube, thereby reducing the size of the lumen of the tube and spreading the tube laterally for a short distance adjacent the ends. As shown in FIGS. 2 and 3, the ends 58, 60 of the tube can be crimped down over the fusible element 52 to draw the material of the tube inwardly against the fusible element in a manner that provides at least one restricted opening 62 between the fusible element and the tube at each end of the tube. Opening 62 is large enough to vent gases while nevertheless substantially excluding the pulverulent material. This can be accomplished as shown in FIGS. 2 and 3 by folding or crimping together one or both lateral edges of the tube at the ends, and sealing them together, e.g. , by heat sealing, such that the sealed portions of the lateral edges do not extend inwardly completely up to the corresponding edge of fusible ribbon or wire 52. Thus a restricted area gap 62 is provided at the respective opposite ends 58, 60 of the sleeve 54, with the gap being unrestricted along the inside length of the sleeve to provide a spaced apart relationship between the fusible element 52 and the sleeve 54. In the embodiment shown, two opposite lateral sides are crimped to provide two gaps 62. Gap 62 as shown in FIG. 3 is also formed in part because the fusible wire or ribbon 62 is rectangular, whereas crimping over only a portion of the distance from the fold inwardly forms an opening of generally triangular cross section with the edge of the fusible material. A similar opening can be formed with a ribbon or wire having another cross sectional shape, such as a different polygonal cross section, for similarly forming a gas permeable barrier for venting of hot metal vapors along the longitudinal axis of the fuse element. The point is to make the tube substantially impermeable to pulverulent material, i.e. , by excluding the arc-quenching filler sand from the inside of the sleeve enclosure, while preserving a means for flow of gas.

The melt and crimp method is preferred since it does not require additional materials and is relatively easy to perform. Other methods to seal the ends such as with the use of Teflon® (PTFE or FEP) or Kapton® (polyimids) tape around the ends of the sleeve can be used as well. Such methods however are less preferred than crimping, since the tape may move more easily out of position during shipping and handling of the fuse.

Also a heat shrink Teflon® (PTFE or FEP) sleeve having a predetermined shrink ratio can be heated at its opposite ends to shrink down over the fusible element to provide end seals without crimping. However, use of heat-shrink seals tend to make it harder to control the gas permeability of the seals, namely to shrink the tubing by an amount sufficient to nearly but not entirely close onto the fusible material. Too complete a seal along the ends of the sleeves should be avoided because gases would be prevented from venting along the ends of the sleeve and would cause an excessive pressure and temperature buildup to develop in the sleeve which, in turn, could burn, decompose and/or rupture the sleeve walls, thus preventing circuit interruption. In addition, the heat shrink method may cause the sleeve wall to break as a result of the fusible element cutting through the sleeve wall, thereby rendering the sleeve enclosure less effective for low fault current interruption. Thus, shrinking the sleeve down over the fusible element must be carefully monitored and shrink ratios carefully calculated. Therefore, it is preferred that the heat shrinkable Teflon® sleeve, if used in this embodiment, be reduced in size a controlled amount over the fusible element but avoiding being cut along the length by the fusible element and completely sealed off at the ends.

Further in this embodiment shown in FIGS. 2 and 3, the air volume in the gap 62 formed along the inside length of the sleeve is minimized in the sleeve enclosure 54 by minimizing the spaced apart distance between the sleeve 54 and fusible element 52. The preferred air volume in the sleeve is from about near zero up to about 0.5 cc. The air volume can be controlled by appropriate non-heat shrink Teflon® sleeve sizes or by heat shrinking a heat shrink Teflon® sleeve down over the body of the fusible element it surrounds. In some cases, the fusible element may be folded over along its longitudinal axis in the sleeve region to ensure a better fit within the sleeve. The reduced air volume in the sleeve is a factor in the circuit interruption performance of the fuse. In general, the larger the air space in the sleeve enclosure, the longer the clearing time of the fuse.

Figure 4:
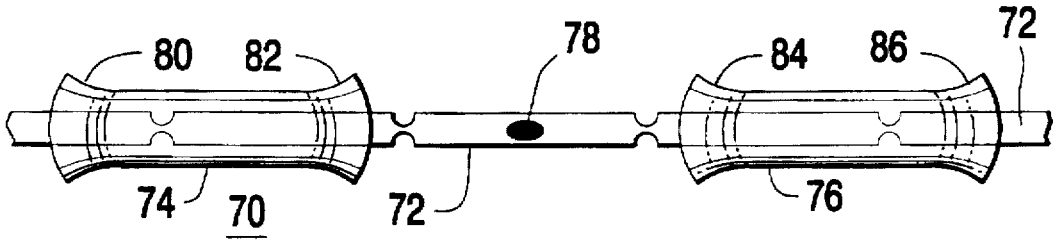
FIG. 4 is a partial view of another embodiment of the sleeved fusible element assembly in accordance with the present invention.

Referring now to the embodiment of FIG. 4, a fusible element and split sleeve assembly 70 is shown which can be included in the fuse of FIG. 1 in place of assembly 50. This fusible element and sleeve assembly 70 includes a silver fusible element 72 generally surrounded by a pair of longitudinally spaced-apart non-heat shrink Teflon® (PTFE or FEP) sleeves 74, 76 along its length, the sleeves 74, 76 being also spaced apart from the fusible element and positioned an equal distance apart from M-effect tinned overlay portions 78 disposed on the fusible element. The separated split sleeves 74, 76 are provided with gas venting but sand-tight end seals 80, 82 and 84, 86, respectively, at their respective opposite ends by the melt and crimp technique as mentioned herein (See, FIGS. 2 and 3) to provide a gas-permeable seal that excludes the pulverulent sand from the sleeve enclosure. It should be understood that Teflon® or Kapton® tape or heat shrink Teflon® (PTFE or FEP) material can be used as well to provide the desired sealed ends.

Figure 5:
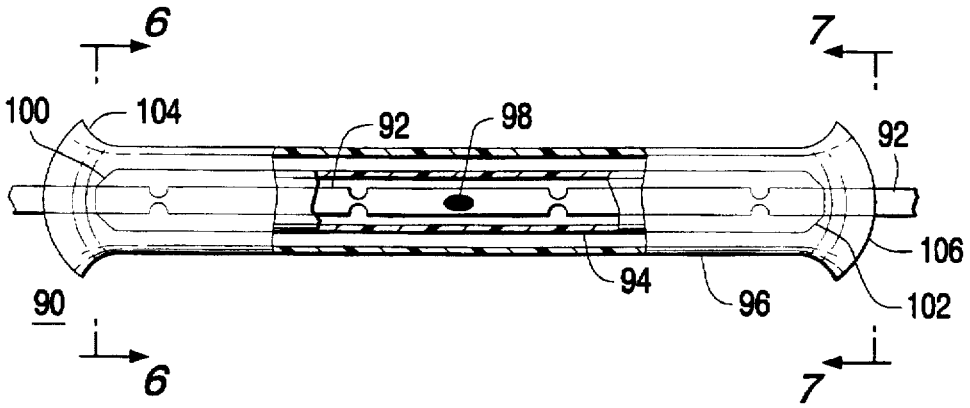
FIG. 5 is a partial view of a further embodiment of the sleeved fusible element assembly in accordance with the present invention.
Figure 6:
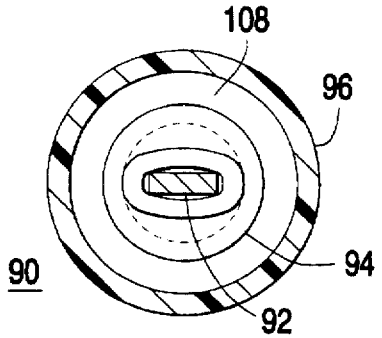
FIG. 6 is a cross-sectional view of the sleeved fusible element assembly of FIG. 5, taken along line 6—6 of FIG. 5.
Figure 7:
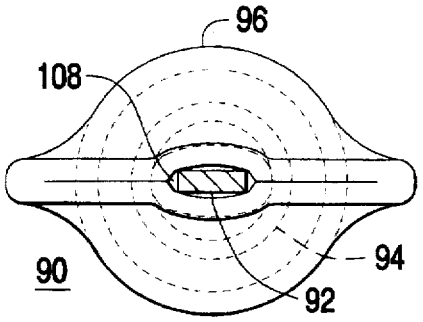
FIG. 7 is a cross-sectional view of the sleeved fusible element assembly of FIG. 5, taken along line 7—7 of FIG. 5.

Referring now to the embodiment of FIGS. 5, 6 and 7, another fusible element and a multiple sleeve assembly 90 is shown which can be included in the fuse of FIG. 1 in place of assembly 50. This fusible element and sleeve assembly 90 includes a silver fusible element 92 generally surrounded at a selected portion along its length, preferably in a spaced apart relationship, by multiple sleeves 94, 96, preferably made of Teflon® (PTFE or FEP) material, layered on top of each other, preferably symmetrically about a M-effect tin overlay 98 disposed on the fusible element. In this embodiment, the multiple sleeve layers are provided to prevent side wall burn through the outermost sleeve submersed in the arc-quenching filler sand. The inner sleeve 94 may be made of a non-heat shrink or a heat shrink Teflon® material with its respective opposite ends substantially opened, or if desired partially closed to exclude sand but gas permeable as shown. In this embodiment, the inner sleeve 94 is made of heat shrink Teflon® (PTFE or FEP) material and has been shrunk down over the fusible element in a spaced apart relationship along the entire body and further at the ends to form inner sleeve end seals 100, 102.

As shown in FIG. 6, the inner sleeve end seals 100, 102 are gas permeable to allow hot metal vapors to vent therefrom along the longitudinal axis of the fusible element. In the embodiment of FIG. 6, the end seals are not crimped but instead are simply shrunk to an opening size slightly larger than the fusible element. The shrunk seal ends generally engage against the rectangular fusible element at its corners, and arch over the surface of the fusible element between the corners due to the circumference of the shrunken portion of the tube exceeding the peripheral dimensions of the fusible element. The outer sleeve 96 may be made of a non-heat shrink Teflon® or a heat shrink Teflon® material as well but with its respective opposite ends partially closed. In this embodiment, the outer sleeve 96 is non-shrink Teflon® (PTFE or FEP) material and has outer end seals 104, 106 in order to exclude the pulverulent arc-quenching sand from entering the inside of the sleeve enclosure, but still gas permeable to allow the hot metal vapors to vent therefrom along a longitudinal direction of the fusible element.

In FIG. 7, the outer end seals 104, 106 are formed by the melt and crimp method described herein (See, FIGS. 2 and 3), which bonds together the lateral sides of the tube and thus provides a restricted opening 108 at the tube ends. As above, two opposite lateral sides are crimped against one another and sealed from a lateral outer fold line leading inwardly to the fusible element, but not extending fully up to the fusible element so as to leave a generally rectangular gap and/or such that the inner surfaces of the crimped and sealed tube ends arch over the respective surfaces of the fusible element, leaving a gap 108 that is relatively small with respect to the size of the granular pulverulent material.

Figure 8:
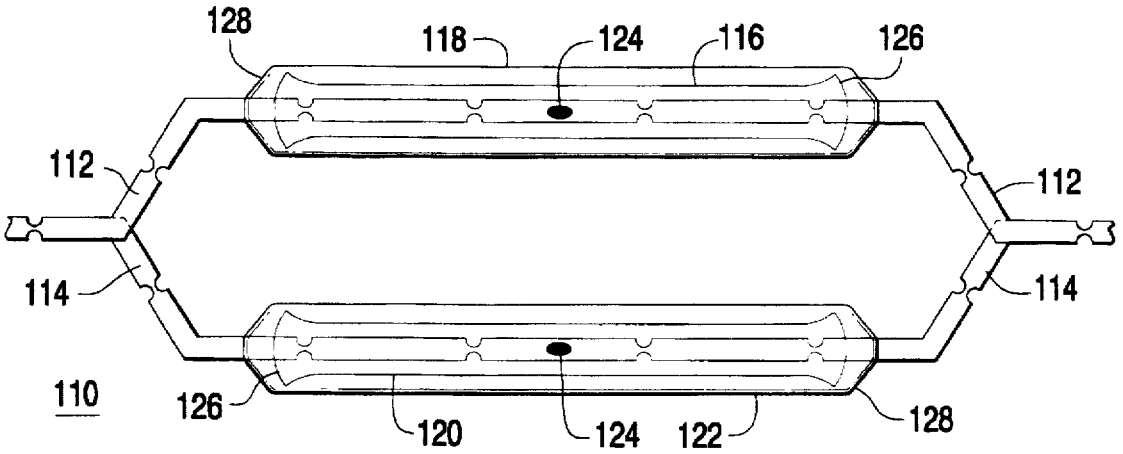
FIG. 8 is a partial view of another embodiment of the sleeved fusible element assembly in accordance with the present invention.

Referring to the embodiment of FIG. 8, a dual fusible element and sleeve assembly 110 is shown which can be included in the fuse of FIG. 1 in place of assembly 50. This fusible element and sleeve assembly 110 includes dual, parallel-connected, silver fusible elements 112, 114. The dual fusible elements 112, 114 are generally touching but are also spaced-apart at a selected portion, and the fusible elements at this portion are generally surrounded by a multi-layered sleeve arrangement 116, 118 and 120, 122, respectively. In this embodiment, the sleeve arrangement includes inner non-heat shrink Teflon® (PTFE or FEP) sleeves 116, 120 surrounded by outer heat shrink Teflon® (PTFE or FEP) sleeves 118, 122, the sleeves being positioned preferably symmetrically about M-effect tinned overlay portions 124 disposed on each of the fusible elements. The inner sleeves 116, 120 are provided with venting, sand-tight end seals 126 at their respective opposite ends by the melt and crimp method (See, FIGS. 2 and 3), and the outer sleeves 118, 122 are also provided with venting, sand-tight end seals 128 by heat shrinking over the non-heat shrink inner sleeves, which end seals exclude the pulverulent sand from the sleeve enclosure (See, FIG. 6).

With the fusible element and the improved sleeve arrangements disposed around the fusible element having, inter alia, controlled gas venting along the longitudinal ends thereof and controlled air gaps, a reduction in the minimum interruption current will result, such that the high voltage fuse will effectively operate with closer to full-range capabilities over the entire range of fault currents above the continuous current rating of the fuse. These improved high voltage current limiting fuses can be used in transformer and distribution protection applications or other suitable applications.

The invention will be further clarified by a consideration of the following examples, which are intended to be exemplary of the use of the first embodiment of the high voltage current limiting fuse of the invention and not limiting.

Figure 9:
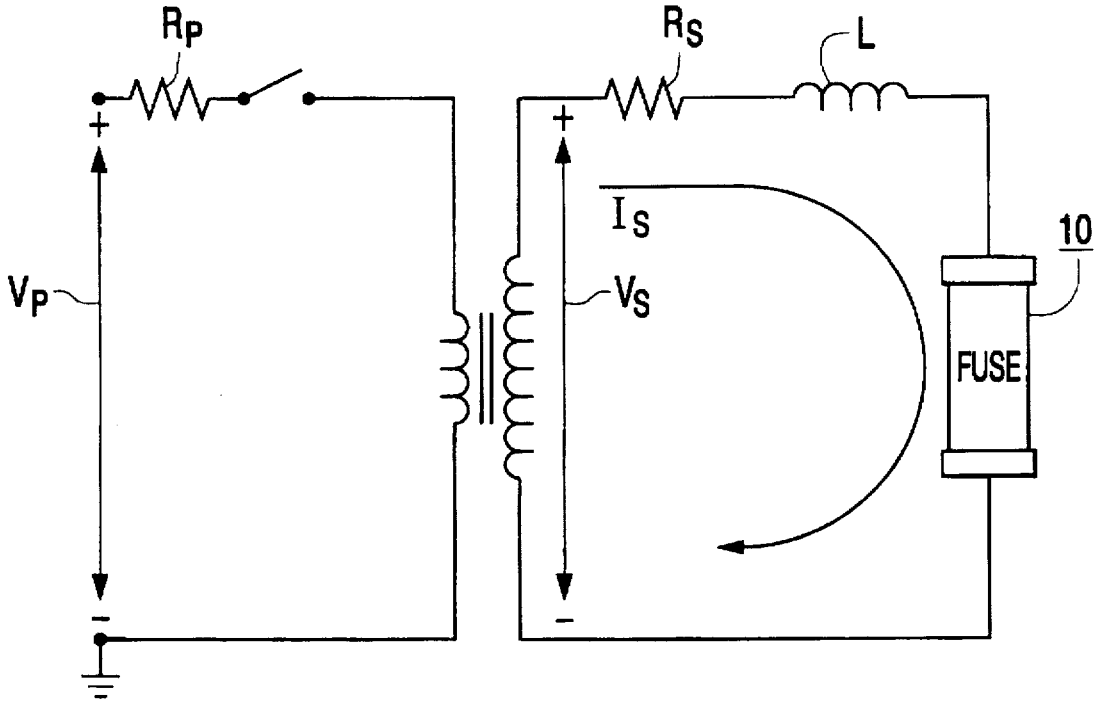
FIG. 9 is a schematic diagram of a circuit for testing the operation of high voltage fuses, especially under low fault current conditions.

EXAMPLE 1 Low Fault Current Interruption in a Single Element Sand-Filled High Voltage Fuse A high voltage sand-filled fuse was made using a conventional sand-filled fuse design and included a single, ribbon-type, side notched, silver fusible element with a tinned portion disposed thereon in the center region and a non-heat shrink PTFE sleeve symmetrically disposed around the tinned portion of the fusible element and closed at its respective opposite ends with insulative tape. The fusible element and PTFE sleeve assembly was disposed in a 17 inch glass resin outer tubular casing and submersed in a round arc-quenching silica sand, and conductive end caps closed the ends of the tubular casing, thereby electrically connecting the single element fuse to the test circuit as shown in FIG. 9. The test parameters and results are shown in Table 1.

TABLE 1

| Fuse Information | Test Parameters | Results |
|---|---|---|
| Sleeve: 3" Translucent PTFE Tube<br>End Seals: Insulative Kapton Tape<br>Element(s): 1 Silver Ribbon (17")<br>(0.050" × 0.0015")<br>Fuse Orientation: Vertical<br>Sand: Round<br>Casing: 17" Glass-Epoxy (1" dia.)<br>Overlay: Tin | $R_p$ = 16 mOhm<br>$R_s$ = 200 Ohms<br>L = 65 mH<br>$V_p$ = 480 $V_{rms}$ | $I_s$ = 30.6 $A_{rms}$<br>$V_s$ = 16.9<br>$kV_{rms(Open\ Circuit)}$<br>Arcing Time = 13.7 ms<br>Melt Current = 8 $A_{rms}$<br>Total Restrikes = 0<br>$I^2t$ = 13.9 $A^2s$<br>Power Factor = 99.3% |

EXAMPLE 2 Low Fault Current Interruption in a Single Element Sand-Filled High Voltage Fuse A high voltage sand-filled fuse was made using a conventional sand-filled fuse design and included a single, ribbon-type, side notched, silver fusible element with a tinned portion disposed thereon in the center region and a non-heat shrink PTFE sleeve symmetrically disposed around the tinned portion of the fusible element and closed at its respective opposite ends with melted and crimped end seals. The fusible element and PTFE sleeve assembly was disposed in a 17 inch glass resin outer tubular casing and submersed in a round arc-quenching silica sand, and conductive end caps closed the ends of the tubular casing, thereby electrically connecting the single element fuse to the test circuit as shown in FIG. 9. The test parameters and results are shown in Table 2.

TABLE 2

| Fuse Information | Test Parameters | Results |
|---|---|---|
| Sleeve: 3" Translucent PTFE Tube<br>End Seals: Melted and Crimped<br>Element(s): 1 Silver Ribbon (17")<br>(0.050" × 0.0015")<br>Fuse Orientation: Vertical<br>Sand: Granusil ® Grade 40<br>Casing: 17" Glass-Epoxy (1" dia.)<br>Overlay: Tin | $R_p$ = 16 mOhm<br>$R_s$ = 75 Ohms<br>L = 65 mH<br>$V_p$ = 480 $V_{rms}$ | $I_s$ = 97.9 $A_{rms}$<br>$V_s$ = 15.8<br>$kV_{rms(Open\ Circuit)}$<br>Clearing Time = 30.4 ms<br>Melt Current = 20 $A_{rms}$<br>Total Restrikes = 0<br>$I^2t$ = 217 $A^2s$<br>Power Factor = 95.1% |

EXAMPLE 3 Low Fault Current Interruption in a Multi-Element Sand Filled High Voltage Fuse A high voltage multi-element sand-filled fuse was made using a conventional sand-filled fuse design and included six (6), ribbon-type, side notched, helically wound, silver fusible elements with a tin portion disposed in the center regions of each element, and six (6) heat shrink PTFE sleeves symmetrically disposed around the tinned portion of the respective fusible elements and closed at their respective opposite ends by heat shrinking the PTFE around the end portions of the sleeves. The fusible element and sleeve assembly was disposed in a 17 inch glass resin outer tubular casing, enveloped therein in a cylindrical body of arc-quenching silica sand, and conductive end caps closed the ends of the tubular casing, thereby electrically connecting the multi-element fuse to the test circuit as shown in FIG. 9. The test parameters and results are shown in Table 3.

TABLE 3

| Fuse Information | Test Parameters | Results |
|---|---|---|
| Sleeve: 3" Translucent PTFE Tube<br>End Seals: Heat Shrink<br>Element(s): 6 Silver Ribbons<br>(Outer Helix)<br>(0.050" × 0.0032" × 36")<br>Fuse Orientation: Vertical<br>Sand Type: Granusil ® Grade 40<br>Casing: 17" Glass-Epoxy (3" dia.)<br>Overlay: Tin | $R_p$ = 16 mOhm<br>$R_s$ = 250 Ohms<br>L = 65 mH<br>$V_p$ = 440 $V_{rms}$ | $I_s$ = 34.8 $A_{rms}$<br>$V_s$ = 13.9<br>$kV_{rms(Open\ Circuit)}$<br>Clearing Time = 63.8 ms<br>Melt Current = 90 $A_{rms}$<br>Total Restrikes = 0<br>$I^2t$ = 72.7 $A^2s$<br>Power Factor = 99.5% |

EXAMPLE 4 Low Fault Current Interruption in a Multi-Element Sand Filled High Voltage Fuse A high voltage multi-element sand-filled fuse was made using a conventional sand-filled fuse design and included ten (10), ribbon-type, side notched, helically wound, silver fusible elements with a tin portion disposed in the center regions of each element, and ten (10) non-heat shrink PTFE sleeves symmetrically disposed around the tinned portion of the respective fusible elements and closed at their respective opposite ends with melted and crimped end seals. In order to build up the wall thickness of the sleeves, each PTFE sleeve comprised three layers of PTFE tubes one inside the other. The fusible element and sleeve assembly was disposed in a 17 inch glass resin outer tubular casing, enveloped therein in a cylindrical body of arc-quenching silica sand, and conductive end caps closed the ends of the tubular casing, thereby electrically connecting the multi-element fuse to the test circuit as shown in FIG. 9. The test parameters and results are shown in Table 4.

TABLE 4

| Fuse Information | Test Parameters | Results |
|---|---|---|
| Sleeve: Tri-Layer 2" PTFE Tubes<br>End Seals: Melted and Crimped<br>Element(s): 10 Silver Ribbons<br>(Inner and Outer Helix)<br>(0.050" × 0.0032" × 36")<br>Fuse Orientation: Vertical<br>Sand Type: Granusil ® Grade 40<br>Casing: 17" Glass-Epoxy (3" dia.)<br>Overlay: Tin | $R_p$ = 33 mOhm<br>$R_s$ = 75 Ohms<br>L = 65 mH<br>$V_p$ = 480 $V_{rms}$ | $I_s$ = 84.8 $A_{rms}$<br>$V_s$ = 16<br>$kV_{rms(Open\ Circuit)}$<br>Arcing Time = 55.6 ms<br>Melt Current = 150 $A_{rms}$<br>Total Restrikes = 0<br>$I^2t$ = 357 $A^2s$<br>Power Factor = 95.1% |

Figure 10:
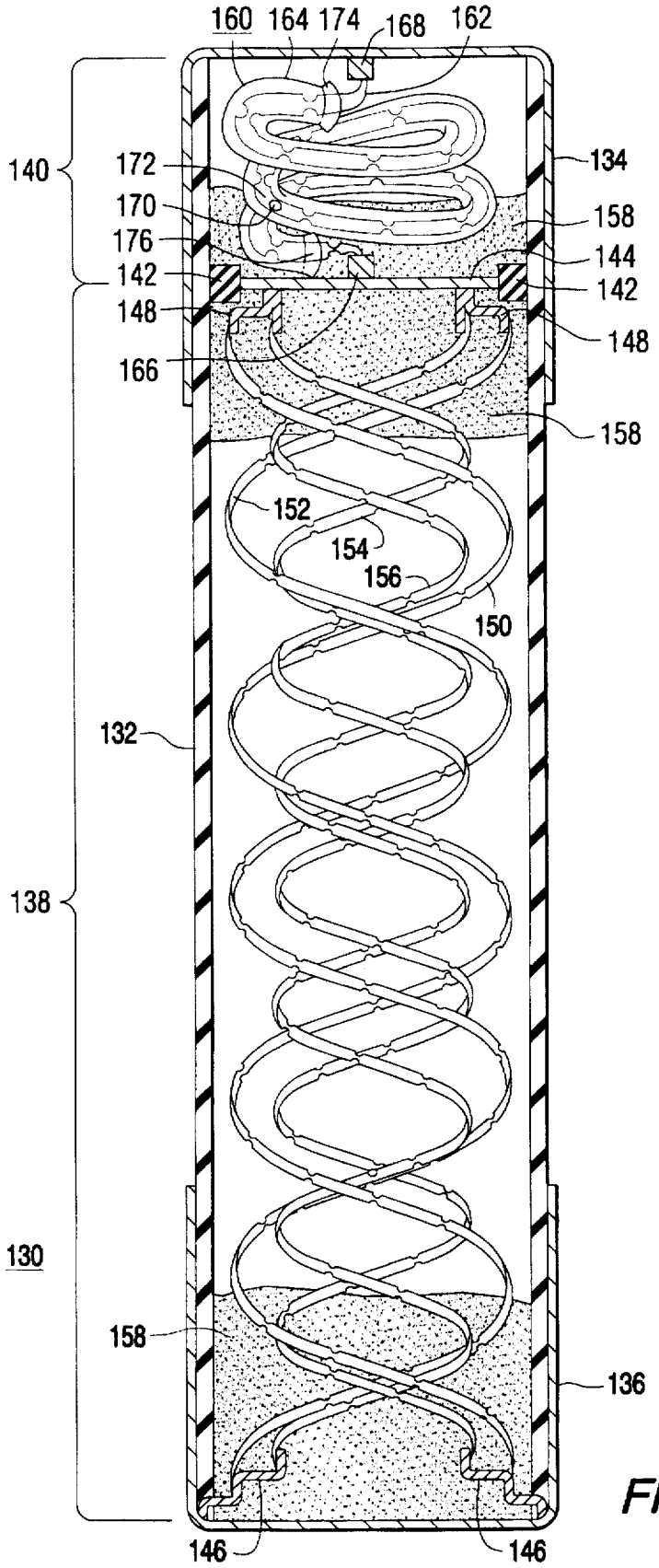
FIG. 10 is a side elevation, partly-sectional view of another embodiment of a high voltage fuse in accordance with the present invention.

Referring now to FIG. 10, a second embodiment of a high voltage current limiting fuse 130 with improved low overcurrent performance is shown. This fuse 130 contains a sleeve and fuse assembly for improved low overcurrent interruption. This fuse 130 further includes a modified fuse structure, as compared to the improved low overcurrent fuse design with a fusible element and sleeve assembly as shown in FIG. 1 (which was based on a conventional sand-filled fuse structure), for greater ease of assembly of the low overcurrent fusible element and sleeve assembly into the fuse. In this embodiment, the fuse 130 includes a tubular casing 132 of insulative material, for example, glass reinforced epoxy resin, forming an outer chamber surrounding a hollow interior cavity. Two conductive end terminals or end ferrules 134, 136, for example, copper ferrules, are attached in a suitable manner onto the tubular casing 132 at its opposite ends, closing each of the opposite ends of the fuse. The end ferrules 134, 136 provide a means for electrically connecting the fuse into an external circuit (not shown) containing a load (not shown) that is to be protected from fault conditions, such as overloads or short circuits.

As shown in FIG. 10, the inside of the tubular casing 132 is divided into two sections, a short circuit power handling section 138 and a low overcurrent power handling section 140. The short circuit section 138 contains elements that are normally found in conventional sand-filled fuses. The short circuit section 138 is partitioned from the low overcurrent section 140 through an insulator ring 142 of insulative material, for example, glass filled epoxy resin, connected to the inside walls of the casing and disposed at a selected distance along the length of the casing. The insulator ring 142 can be connected to the casing in any suitable manner, for example, through placement of the insulator ring on a small lip (not shown) of insulative material extending around the inside periphery of the casing at the desired location. Attached to the inside periphery of the insulator ring 142 is another conductive terminal or partition ferrule 144, for example, a copper ferrule, which in this embodiment is shown as being in disc form. The partition ferrule 144 extends across and occupies the annulus of the insulator ring 142, thereby conductively dividing the short circuit section 138 from the low overcurrent section 140. The partition ferrule 144 can be attached to the insulator ring 142 in any suitable manner, for example, through snap fitting the partition ferrule within the annular space of the insulator ring. The insulator ring 142 is provided as a precautionary component to prevent the sides of the end terminal 134 from arcing over to the partition ferrule 144. However, the insulator ring 142 can be an optional component in the fuse.

Conductive arms 146, 148 are electrically connected to respective opposite ends of the short circuit section 138, particularly to bottom end ferrule 136 and the bottom side of the partition ferrule 144, respectively. The conductive arms 146, 148 which extend within the short circuit section 138 are further electrically connected to conductive fusible elements 150, 152, 154, 156, completing an electrical connection between the end terminal 136 and partition terminal 144 in the short circuit section. It is preferred that the fusible elements 150, 152, 154, 156 are made of silver, but the other metals listed for the fusible elements herein can also be used. It is also preferred that the fusible elements are provided with notches and are in ribbon form, but other forms described herein can also be used. Although not shown in detail in FIG. 10 for the sake of simplicity, the fusible elements, conductive arms, and ferrules are all electrically connected to each other respectively in a suitable manner known in the art, such as by welding, soldering or the like.

Furthermore, a single fusible element may be employed as is known in the art, however, the embodiment shown in FIG. 10 has multiple fusible elements extending between the terminals in the short circuit section. The length, thickness (or diameter), and number of fusible elements can be determined by the permissible fuse resistance, voltage rating, power factor, and desired interruption current level, as is well known in the art. The multiple fusible elements 150, 152, 154, 156 are electrically connected in parallel with each other and are spirally or helically wound in a spaced-apart relationship to each other to meet the resistance requirements of the fuse as is well known in the art. It is preferred that the fusible elements are self-supporting and not wound about a core, but a core (not shown) of insulative material, for example, a tube of vitrified ceramic, can be placed centrally or otherwise to support the fusible elements as is well known in the art.

In the embodiment shown in FIG. 10, it is preferred not to include an M-effect overlay onto the fusible elements in the short circuit section, since interruption of low overload currents is generally not performed in this section 138 of the fuse. The short circuit section 138 generally performs high overload current interruption in this two compartment fuse 130, and, consequently, there is no need to assist in initiating fuse operation at low overload currents in this short circuit section. Furthermore, in this embodiment, a gas-evolving material (not shown) can, however, be included in short circuit section. The gas-evolving material can be disposed in close proximity to the fusible element, preferably adjacent to the arcing regions, to assist in rapidly quenching the smack arc as is well known in the art. The gas-evolving material can be made of any of the materials as mentioned herein and further incorporated by any of the methods as mentioned herein.

The short circuit section 138 is filled with a pulverulent arc-quenching filler material 158, thereby submersing the fusible elements in the filler. It is preferred that the pulverulent filler is made of sand, but other filler materials mentioned herein can be used. For the sake of clarity of FIG. 10, the pulverulent arc-quenching filler 158 in the short circuit section 138 is shown as only partially filling the tubular casing 132 of the short circuit section, although in actuality it preferably fills all voids in the entire short circuit section portion of the casing. Consequently, the short circuit section is designed to operate like a conventional sand-filled high voltage current limiting fuse and effectively limit generally high fault currents, such as short circuits.

To combat the problems of the ineffectiveness of a conventional sand-filled fuse to interrupt a low overload current in a high voltage circuit, generally as a result of slow or limited burn-back of the fusible elements or conduction through fulgurites formed in the sand, an improved two compartment fuse arrangement 130 is provided. The fuse 130 incorporates a fusible element and sleeve assembly 160 in a separate compartment from a conventional short circuit section to interrupt low overload currents. The low overcurrent section 140 of the fuse as shown in FIG. 10, which is not found in conventional sand-filled fuses, performs this low overload current interruption function. The low overcurrent section 140 includes a fusible element and sleeve assembly 160 electrically connected in series with the conductive elements of the short circuit section 138. The fusible element and sleeve assembly 160 includes a fusible element 162, preferably made of silver, which is shown in notched ribbon form, but other forms as mentioned herein, for example, cylindrical wire form, can be used as well. The fusible element and sleeve assembly 160 further includes a sleeve 164, preferably of a tubular polymeric insulative material, for example, PTFE polymers, FEP polymers (both referred to herein as Teflon®), non-heat shrink or heat shrink, or other suitable materials mentioned herein, with a non-heat shrink PTFE sleeve being shown. The Teflon®

(PTFE or FEP) sleeve 164 is generally placed around the fusible element 162 along its length at a selected arcing region. The sleeve 164, thus, forms a chamber that surrounds in a spaced apart relationship the selected portion of the fusible element, to exclude the arc-quenching filler from this region and, consequently, improve the low overload current interruption characteristics. The sleeve length depends upon the voltage rating of the fuse. In general, the higher the voltage rating of the fuse, the longer the sleeve.

The fusible element and sleeve assembly 160 is generally coiled within the low overcurrent section 140 to accommodate its generally increased length as compared to the sleeve and fusible assembly as shown in FIG. 1. The fusible element 162 is further electrically connected to respective opposite ends of the low overcurrent section, particularly to the top side of the partition ferrule 144 and the top end ferrule 134 through conductive arms 166, 168, respectively, which are electrically connected to the partition ferrule 144 and end ferrule 134 and extend within the low overcurrent section. The fusible element, conductive arms, and ferrules are all electrically connected to each other respectively in a suitable manner known in the art, such as by welding, soldering or the like, to complete the fuse circuit.

The low overcurrent section is also filed with a pulverulent arc-quenching filer material 158, thereby submersing the fusible element and sleeve assembly in the filer. It is again preferred that the pulverulent filer 158 is made of sand, although the other filer materials mentioned herein can be used. For the sake of clarity of FIG. 10, the pulverulent arc-quenching filler 158 in the low overcurrent section is shown as only partially filing the tubular casing 132 of the low overcurrent section, although in actuality it preferably fills all voids in the entire low overcurrent section portion of the casing.

As shown, the arc-quenching filler sand 158 is excluded by sleeve 164 from the fusible element 162 along the length of the sleeved enclosure and at the ends thereof through the use of end seals 174, 176. The end seals 174, 176 are shown as being of the kind that are formed by melting and crimping the respective opposite ends of the sleeve down onto the fusible element. These end seals are described herein and, furthermore, are shown in FIGS. 2 and 3. The end seals are designed to allow venting of the hot plasma generated during vaporization of the fusible element into the pulverulent sand filer 158 but exclude the pulverulent sand filler from entering the sleeved chamber generally in the gap formed between the sleeve and the fusible element. Other kinds of end seals and fusible element and sleeve assemblies as described herein can also be used in this embodiment.

Whatever sleeve assembly is used, the end seals are provided to exclude the sand pulverulent filler 158 from contact or intimate association with the fusible element adjacent the arcing regions, thereby preventing fulgurite formation in this sleeve region and, consequently, preventing tracking of the arc in this region. Moreover, the end seals 174, 176 are provided to allow the generated hot gases, such as the hot silver metal vapor plasma, to vent longitudinally over the length of the enclosed fusible element and out of the sleeve ends 174, 176 into the arc-quenching sand, thus aiding the rapid burn-back of the fusible element and quenching of the arc, while also preventing rupture of the sleeved enclosure. Furthermore, in this embodiment the venting end seals of the sleeve 164 are pointed into the sand and not toward the ferrules to allow proper venting of the hot plasma into the sand and prevent dielectric breakdown between end cap ferrule 134 and partition ferrule 144 located in the low overcurrent section 140.

To assist in initiating fuse operation at low overload currents, the fusible elements 164 in the low overcurrent section 140 can include at least one M-effect overlay 170 to cause fusing of the fusible element in this region at a lower than normal temperature, thereby reducing the time required to form associated arcs at the overlay locations during low overload current conditions, as previously described herein. The M-effect overlay is preferably made of indium, although tin or other metals or alloys which form a lower melting eutectic with the fusible element may be used. The M-effect overlay 170 can be disposed inside the sleeve 164 and on the fusible element 162 adjacent the arcing regions of the fusible element. It is preferred that the sleeve 164 is preferably positioned symmetrically about the M-effect overlay 170.

In addition, a gas-evolving material 172 can be disposed in close proximity to the fusible element inside the sleeve 164 prior to sealing to assist in low overload current interruption. The gas-evolving material 172 can be made of any of the materials mentioned herein and farther incorporated by any of the methods as mentioned herein, to aid in extinction of the arc. Arc extinction is facilitated by having the gas-evolving material rapidly evolve a deionizing gas upon vaporization of the fusible element. The deionizing gas produced from the gas-evolving material reduces the conduction through gases ionized by the arc and also enhances cooling of the arc to bring the current through the fusible element to a zero value.

In FIG. 10, the fusible element and sleeve assembly 160 shown in the low overcurrent section 140 includes one fusible element 162 surrounded with one insulative polymeric sleeve 164 along the length of the fusible element for low overload current circuit interruption. It should be understood that multiple fusible elements connected in parallel surrounded with corresponding multiple insulative sleeves can be employed in this section as well depending on the permissible fuse resistance, voltage rating, power factor, and desired interruption current level.

In this two section fuse arrangement 130 as shown in FIG. 10, the sleeve and fusible element that is located in the low overcurrent section can be assembled in quantity prior to the general assembly of the fuse. This can reduce assembly time of the fuse as compared to a fuse arrangement as shown in FIG. 1 where a sleeve is assembled on each of the multi-fusible elements. Furthermore, less fusible elements need to be sleeved in this arrangement rather than providing a sleeve on each of the helically wound parallel fusible elements as shown in the embodiment of FIG. 1. Also, the associated problems of breakage of the fusible elements during direct assembly of individual sleeves on the pre-assembled helically wound parallel multi-fusible elements can be avoided in the embodiment of FIG. 10.

In assembly, the short circuit section can be built first, filled with sand, and then prior to sealing the fuse with the end cap, the pre-assembled low overcurrent section can be attached and coiled into the end of the fuse casing. The casing can then be topped off with sand and the end cap put in place. Moreover, there is no need to place M-effect overlays over each individual fusible element in the short circuit section, thus reducing the cost of assembly. Furthermore, in the embodiment of FIG. 10, the sleeve length around the fusible element can be increased in the low overcurrent section to cover the entire length of the fusible element in order to enhance its low overload current interruption performance. In contrast, in the embodiment of FIG. 1, the length of the sleeves around the fusible elements are generally shorter, since most of the length of the fusible elements should be exposed and in intimate contact with the sand filler to effectively interrupt short circuit currents, i.e., the fuses primary function. Increasing the sleeve length can detract from high fault current interruption capabilities in the embodiment of FIG. 1 which can be highly detrimental to the interruption performance of a fuse. In contrast, the embodiment of FIG. 10 effectively separates the low overcurrent element from the short circuit element to allow each to separately perform their respective functions without interfering with the other. Thus, a greater sleeve length around the fusible element and better low overload current interruption performance can be achieved in the low overcurrent section without detrimentally affecting the performance of the short circuit interruption performance in the short circuit section where the fusible elements should be in direct contact with the arc-quenching filler.

Figure 11:
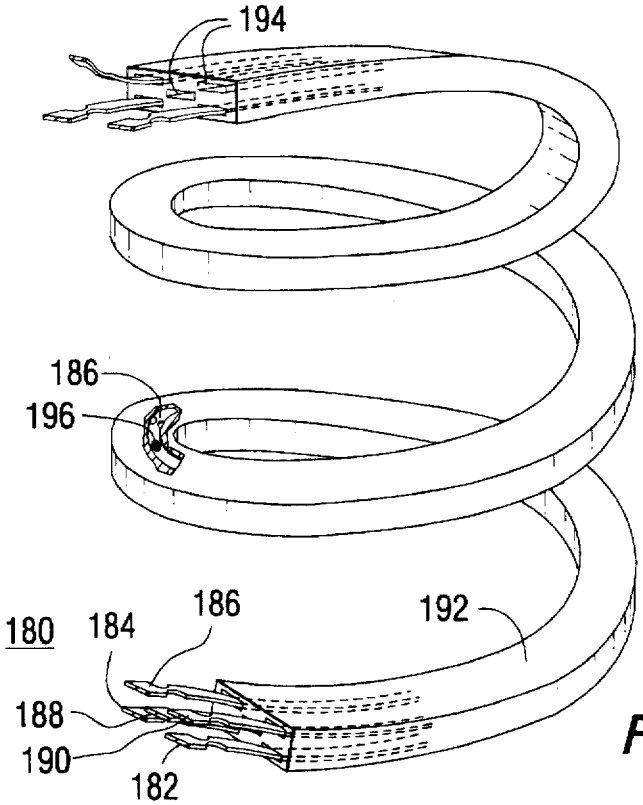
FIG. 11 is partial view of still another embodiment of a sleeved fusible element assembly in accordance with the present invention; and, FIG. 12 is a partial view of yet another embodiment of a sleeved fusible element assembly in accordance with the present invention.

Referring now to FIG. 11, another embodiment of a fusible element and sleeve assembly 180 for low overcurrent interruption is shown which can be used in the low overcurrent section 140 of the two compartment fuse arrangement of FIG. 10 in place of the sleeve and fusible element assembly 160. In this embodiment, the fusible element and sleeve assembly 180 includes a plurality of elongated spaced apart, parallel connected, fusible elements 182, 184, 186, 188, 190. The fusible elements are preferably made of silver and preferably provided in notched ribbon form, although other forms as mentioned herein including cylindrical wire form can also be used. A selected portion of each of the fusible elements are generally surrounded by a sleeve 192 of insulative polymeric material, for example, FIFE polymers, FEP polymers (both referred to herein as Teflon®), non-heat shrink or heat shrink, or other suitable materials mentioned herein. As shown, the Teflon® (PTFE or FEP) sleeve 192 contains multiple passageways 194, each passageway providing a chamber for an individual fusible element as well as separating the individual fusible elements from each other. The sleeve 192 protects the fusible elements from exposure to the arc-quenching sand filler. In this embodiment, each fusible element 182, 184, 186, 188, 190 being threaded through a separate passageway 194 in the sleeve 192. The respective opposite ends of the fusible elements are then electrically connected such as by welding, twisting, or otherwise contacting together, coiled in the low overcurrent section 140 of the fuse, and electrically attached to the low overcurrent fuse terminals 134, 144 through the conductive arms 168, 166. The sleeve containing the multiple passageways can be extruded as such or can be formed from individual tubes bonded together, with the pre-formed extruded tubes being preferred. In this embodiment the sleeve 192 is shown as having a rectangular shape, although other shapes and forms can be used.

Further in this embodiment, M-effect overlays 196 can be included on each fusible element. Again, the M-effect overlays are preferably made of indium, although tin or other metals or alloys which form a lower melting eutectic with the fusible element may be used. An M-effect overlay 196 can be disposed inside the passageways 194 and on each of the fusible elements 184, 186, 188, 190, 192 adjacent the arcing regions of the fusible element. It is preferred that passageways are preferably positioned symmetrically about the M-effect overlays 196. The M-effect overlays are preferably positioned near the center of the passageways. Moreover, the M-effect overlays 196 may be positioned in a staggered relationship to each other on adjacent fusible elements in adjacent passageways to avoid generation of excessive heat on the walls of the passageways.

An optional PTFE powder (not shown) can be incorporated inside the passageways of the sleeve in the gap surrounding the fusible elements. The PTFE powder upon arcing of the fusible element vaporizes and evolves fluorine gas. The fluorine gas is provided to aid in deionizing the hot plasma in the sleeved enclosure during fusing and to obstruct the arc path. Fluorine gas is an electronegative gas which will capture electrons present in the metal plasma, thereby deionizing the gap. This effect is similar to that produced by a gas-evolving material mention herein.

In addition, non-heat shrink Teflon® (PTFE or FEP) or heat shrink Teflon® (PTFE or FEP) tubing can be used as the sleeve. In order to create a tight form fitting and reduced air volume around the fusible element, a heat shrink Teflon® can be used. As shown, in FIG. 11, the passageways generally conform to the configuration of the fusible element and can be sized to be slightly larger than the fusible elements to provide a snug fit that does not require end seals of the kind above described. Although not shown in FIG. 11, the end seals mentioned herein can also be used when desired to exclude the arc-quenching filler from infiltrating the space between the passageway and fusible element.

The length, thickness (or diameter), and number of fusible elements can be determined by the permissible fuse resistance, voltage rating, power factor, and desired interruption current level, as is well known in the art. In general, the greater the number of fusible elements provided in parallel with each other, the lower the resistance inserted in the fuse as is well known in the art and preferred in the fuse of FIG. 10. Also, the thickness of the fusible elements depends on the acceptable burn-back rate of the fusible element. Thus, the thinner the fusible elements for a given width, the greater the burn-back rate as is well known in the art and also preferred in the fuse of FIG. 10. The sleeve length in the low overcurrent section also depends upon the voltage rating, power factor, and desired interruption current level of the fuse. In general, the higher the voltage rating, the lower the power factor, and the lower the desired interruption current level of the fuse, the longer the sleeve. By having the ability to lengthen the sleeve through coiling in the separate low overcurrent section to any desired length without altering the high current interruption capabilities, this will allow low current faults to be reliably cleared.

Figure 12:
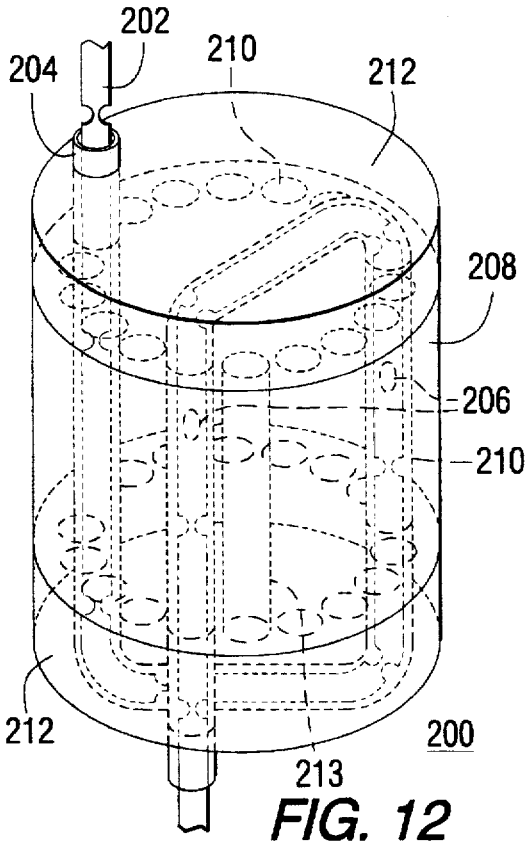

Referring now to FIG. 12, yet another embodiment of a fusible element and sleeve assembly 200 for low overcurrent interruption is shown which can be used in the low overcurrent section 140 of the two compartment fuse arrangement of FIG. 10 in place of the sleeve and fusible element assembly 160. In this embodiment, the fusible element and sleeve assembly 200 includes a plurality of elongated spaced apart, parallel connected, fusible elements 202. For the sake of clarity of FIG. 12, only one fusible element is shown. Again, the fusible elements are preferably made of silver and preferably provided in notched ribbon form, although other forms as mentioned herein can be used. Moreover, one fusible element can be used instead of multiple fusible elements depending on the rating of the fuse. A selected portion of each of the fusible elements are generally surrounded by a sleeve 204 of insulative polymeric material, for example, PTFE polymers, FEP polymers (both referred to herein as Teflon®), non-heat shrink or heat shrink, or other suitable materials mentioned herein. M-effect overlays 206 can be disposed on selected portions of the fusible elements inside the sleeve.

In this embodiment of FIG. 10, a structural block 208 of insulative polymeric material, preferably non-heat shrink PTFE polymers, Flip polymers (both referred to herein as Teflon®), or thermoplastic insulative polymers, for example, glass polyester polymers, polyacetal polymers, and melamine polymers, is provided. The Teflon® (PTFE or FEP) block preferably is in cylindrical form with a diameter and height sized to fit within the tubular casing of the fuse and substantially fill the volume of the low overcurrent section 140 of the fuse. The block 208 is provided in the low overcurrent section in place of the pulverulent arc-quenching filler sand material. However, some pulverulent arc-quenching filler can remain in this section, if desired, to fill any voids remaining on the sides as well as above and below the block and to further assist in quenching the arc.

The block 208 further contains a plurality of spaced apart channels 210 extending through the height of the block and opening onto the respective opposite ends of the block. The channels are preferably cylindrical to conform to the tubular sleeve, but other shapes are possible. Each sleeve portion of a fusible element is threaded through multiple spaced apart channels in order to coil the fusible element within the block and extend its length in the low overcurrent section of the fuse. Other fusible elements (not shown) are also threaded in the spaced apart channels in the block to provide a multiple element arrangement. It is preferred that the sleeves surround the fusible elements along their length in the channels and the respective opposite ends of the sleeves extend out of the channel into the low overcurrent section. Furthermore, the venting ends of the sleeves are preferably pointed toward the walls of the casing 132 and not toward the ferrules 134, 144 to allow proper venting of the hot plasma into the low overcurrent section during arcing and to prevent dielectric breakdown in the low overcurrent section 140. The block 208 is preferably pre-formed prior to fuse assembly by extrusion. The channels can either be formed therein during extrusion or drilled therein after extrusion. It is also preferred that the ends of the block 208 be sealed with a layer of an appropriate adhesive 212 with high dielectric strength and high temperature resistance and that adheres to a polymeric material, such as an epoxy adhesive or other suitable materials. The adhesive may also form an adhesive bolt 213 disposed within a vacant channel 210. Such adhesive bolt may help to secure to the block 208 the adhesive layer 212 on opposite ends of the block. The adhesive prevents the escape of plasma through the anuluses formed by the channels 210 and the outer surface of the sleeves 204 in the event such sleeve burns through during arcing. The adhesive seal also allows the sleeved fusible elements to maintain their proper positioning in the block and further prevents any pulverulent arc-quenching filler, such as sand, if used in the low overcurrent section, from entering the channels.

In the embodiment of FIG. 12, the cylindrical block 208 prevents the sleeves around the fusible elements from rupturing during arcing. The block 208 also maintains high dielectric characteristics if the sleeves burn through during arcing as compared to sand which has poor dielectric characteristics under low overload arcing current conditions. Also, the block 208 provides additional mechanical support to the fusible elements and maintains them in a spaced apart relationship to prevent shorting of the fusible elements. The block also provides thermal insulation during the melt phase between parallel elements, thereby enhancing the robustness of the PTFE tubes and causing fusing at lower overload currents.

Figure 13:
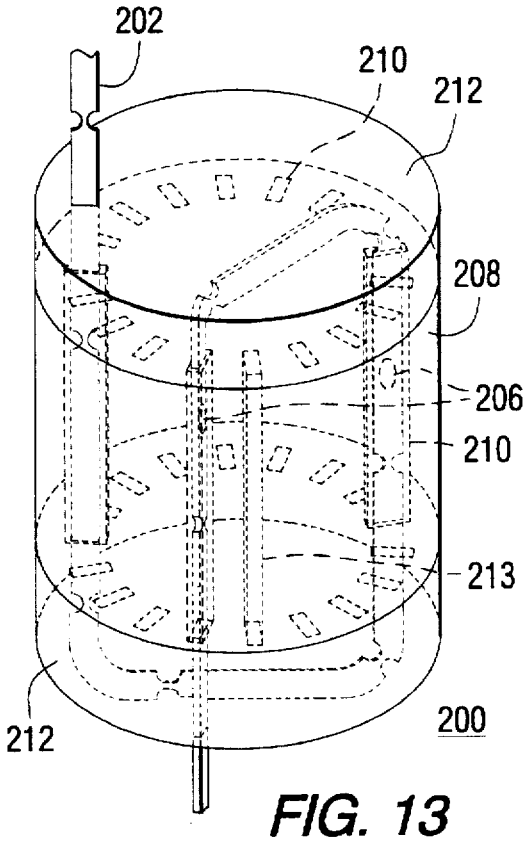
FIG. 13 is a partial view of an embodiment of a non-sleeved fusible element assembly in accordance with the present invention.

In this embodiment, the sleeves need not be end sealed because the pulverulent arc-quenching filler can be eliminated from the low overcurrent section. Furthermore, the sleeves can be eliminated altogether in this embodiment because the fusible element is surrounded by the high dielectric block. For instance, FIG. 13 is an example of this embodiment of the invention in which the sleeves 204 have been eliminated. In FIG. 13 the channels 210 are shown with a rectangular cross-section, however, other shapes are possible. In any event, regardless whether sleeves are used, the end openings of the block channels should be sealed with epoxy adhesive.

With the fusible element and the sleeve arrangements disposed around the fusible element in a low fault current interruption compartment a reduction in the minimum interruption current will result, such that the high voltage fuse will effectively operate with closer to full-range capabilities over the entire range of fault currents above the continuous current rating of the fuse. These improved two compartment high voltage current limiting fuses can be used in transformer and distribution protection applications or other suitable applications.

The invention will be further clarified by a consideration of the following example, which is intended to be exemplary of the use of the second embodiment of the high voltage current limiting fuse of the invention and not limiting.

EXAMPLE 5 Low Fault Current Interruption of a Low Overcurrent Element for a Two Section Sand-Filled High Voltage Fuse A low overcurrent element was made for a two section high voltage sand-filled fuse. The low overcurrent element included six (6) silver side notched ribbon fusible elements with indium portions disposed on each fusible element in the center regions thereof. The low overcurrent element further included having the fusible elements threaded through a non-heat shrink PTFE sleeve that included six (6) spaced apart passageways extending along the length of the sleeve, with the sleeve being symmetrically disposed around the indium portion of the fusible elements. The respective opposite ends of the sleeve were opened. The fusible element and PTFE sleeve low overcurrent assembly was disposed on a 9 inch glass resin outer tubular casing and electrically connected to the test circuit as shown in FIG. 9. No pulverulent arc-quenching filler, such as sand, was disposed in proximity to the low overcurrent element. The test parameters and results are shown in Table 5.

TABLE 5

| Fuse Information | Test Parameters | Results |
|---|---|---|
| Sleeve: 8" PTFE Tube-6 Channels<br>End Seals: None<br>Element(s): 6 Silver Ribbon (0.050" × 0.0032" × 9")<br>Fuse Orientation: Horizontal<br>Sand: None (Exposed to Air)<br>Casing: 9" Glass-Epoxy<br>Overlay: Indium | $R_p$ = 30 mOhm<br>$R_s$ = 75 Ohms<br>L = 65 mH<br>$V_p$ = 480 $V_{rms}$ | $I_s$ = 88.5 $A_{rms}$<br>$V_s$ = 16.7 $kV_{rms(Open\ Circuit)}$<br>Arcing Time = 72.2 ms<br>Melt Current = 50 $A_{rms}$<br>Total Restrikes = 0<br>$I^2t$ = 479 $A^2s$<br>Power Factor = 95.1% |

In industrial application, an exemplary high voltage current limiting fuse of the first and second embodiments of the invention can be rated to carry voltages between about 600 $V_{rms}$ and 38 $KV_{rms}$, most preferably between 5.5 $KV_{rms}$ and 15.5 $KV_{rms}$. The tubular casing length is preferably between about 5 and 18 inches long and its diameter is preferably between about 0.25 to 4 inches. Referring now to a fuse with a 17 inch long casing, the fusible element length in the one section fuse of the first embodiment and in the short circuit section of the fuse of the second embodiment will preferably be about 36 inches long. The sleeve length in the fuse of the first embodiment will preferably be between about 2 and 15 inches long, ranging, for example, from about 2 inches long for a 2 $KV_{rms}$ rated fuse or less and about 15 inches for a 15.5 $KV_{rms}$ or more. The fusible element length in the low overcurrent section of the fuse of the second embodiment will preferably be about 9 inches long. The sleeve length in the low overcurrent section of the fuse of the second embodiment fuse will preferably be about 8 inches long. Also, the fuse of the second embodiment will preferably have a short circuit section of about 15 inches long and a low overcurrent section of about 2 inches long. However, it should be understood that the sizes for the casing, fusible element and sleeve described for a 17 inch long fuse are merely exemplary and non-limiting.

The invention having been disclosed in connection with the foregoing variations and examples, additional variations and embodiments will now be apparent to persons skilled in the art. The invention is not intended to be limited to the variations and examples specifically mentioned, and accordingly reference should be made to the appended claims rather than the foregoing discussion of preferred embodiments, to assess the spirit and scope of the invention in which exclusive rights are claimed.

We claim:

1. A high voltage current limiting fuse, which comprises:

an elongated casing of electrically insulative material having an interior cavity;

a pair of electrically conductive terminals closing each of the opposite ends of said casing;

an elongated fusible element of electrically conductive material disposed within said casing and conductively interconnecting said pair of terminals;

an elongated sleeve of electrically insulative material having an interior cavity spaced around a portion of said fusible element, said sleeve having a pair of gas-permeable, pulverulent-tight, seals closing each of the opposite ends of said sleeve, said seals being formed by at least one of melt crimping respective opposite ends of said sleeve together with said fusible element, heat shrinking each of the opposite ends of said sleeve over said fusible element, and taping the opposite ends of said sleeve to the fusible element; and, a pulverulent arc-quenching filler of electrically insulative material within said casing generally surrounding said fusible element and said sleeve.

2. The high voltage current limiting fuse of claim 1, in which said casing is generally tubular.

3. The high voltage current limiting fuse of claim 1, in which said fusible element comprises at least one of ribbon and wire.

4. The high voltage current limiting fuse of claim 1, in which said fusible element comprises silver.

5. The high voltage current limiting fuse of claim 1, in which said sleeve comprises at least one of non-heat shrink polytetrafluoroethylene and non-heat shrink fluoroethylene polymer.

6. The high voltage current limiting fuse of claim 1, in which said sleeve comprises at least one of heat shrinkable polytetrafluoroethylene and heat shrinkable fluoroethylene polymer.

7. The high voltage current limiting fuse of claim 1, in which said fuse further comprises a core of electrically insulative material for supporting said fusible element, said core extending between the opposite ends of the casing and having said fusible element disposed about said core.

8. The high voltage current limiting fuse of claim 1, in which said fusible element has at least one reduced notched or perforated cross-sections along its length disposed within said sleeve.

9. The high voltage current limiting fuse of claim 1, in which said fuse further comprises at least one of a gas-evolving material and polytetrafluoroethylene powder disposed within or compounded into said sleeve.

10. The high voltage current limiting fuse of claim 1, in which said fuse further comprises an M-effect overlay disposed on a selected portion of the fusible element within the sleeve.

11. The high voltage current limiting fuse of claim 1, in which the pulverulent arc-quenching filler comprises sand.

12. The high voltage current limiting fuse of claim 1, in which said fusible element comprises a plurality of fusible elements helically wound between said terminals in a parallel-connected spaced relationship, each fusible element having at least one of said sleeve spaced around a portion thereof.

13. The high voltage current limiting fuse of claim 1, in which said sleeve comprises a plurality of sleeves spaced around a plurality of selected portions of the fusible element.

14. The high voltage current limiting fuse of claim 1, in which said sleeve is at least two sleeves layered one on top of the other, the bottom sleeve layer being spaced around said portion of said fusible element.

15. The high-voltage current limiting fuse of claim 1, in which said sleeve is spaced around said portion of said fusible element, leaving a gap between the sleeve and the fusible element along the length of said sleeve.

16. The high-voltage current limiting fuse of claim 1, wherein the sleeve is crimped and sealed along at least one lateral side at each of the opposite ends, from a laterally outermost fold partway up to an outer surface of the fusible element, thereby leaving a gap between the sleeve and the fusible element for venting of gases.

17. The high-voltage current limiting fuse of claim 16, wherein the gap is sized substantially to exclude passage of the pulverulent arc-quenching material.

18. The high-voltage current limiting fuse of claim 1, wherein the fusible element has a polygonal cross section and the sleeve has an internal diameter reduced so as to arch over faces of the polygonal cross section, leaving a gap between the sleeve and the fusible element for venting of gases.

19. The high-voltage current limiting fuse of claim 18, wherein the gap is sized substantially to exclude passage of the pulverulent arc-quenching material.

20. A high voltage current limiting fuse, which comprises:

an elongated casing of electrically insulative material having an interior cavity;

a pair of electrically conductive end terminals closing each of the opposite ends of said casing;

an electrically conductive partition terminal connected to the inside walls of the casing, said partition terminal being disposed at a distance along the length of the casing and extending across said casing, dividing said interior cavity of said casing into two electrically series-connected sections, a short circuit section and a low overcurrent section;

the short circuit section comprising at least one elongated fusible element of electrically conductive material disposed within said casing and electrically connected between the first end terminal and the partition terminal, and a pulverulent arc-quenching filler of electrically insulative material within said casing generally surrounding said at least one fusible element in said short circuit section; and, the low overcurrent section comprising at least one elongated fusible element of electrically conductive material disposed within said casing and electrically connected between the second end terminal and the partition terminal, at least one elongated sleeve of electrically insulative material having an interior cavity spaced around a portion of said at least one fusible element, said at least one sleeve having a pair of gas-permeable, pulverulent-tight, seals closing each of the opposite ends of said sleeve, said seals being formed by at least one of melt crimping respective opposite ends of said sleeve together with said fusible element, heat shrinking each of the opposite ends of said sleeve over said fusible element, and taping the opposite ends of said sleeve to the fusible element, and a pulverulent arc-quenching filler of electrically insulative material within said casing generally surrounding said at least one fusible element and said at least one sleeve in the low overcurrent section.

21. The high voltage current limiting fuse of claim 20, in which said at least one fusible element in said low overcurrent section comprises a plurality of parallel-connected spaced elongated fusible elements and said at least one sleeve comprises one elongated sleeve having a plurality of spaced passageways extending through the length thereof, each passageway being spaced around a portion of a separate fusible element.

22. The high voltage current limiting fuse of claim 20, in which said at least one fusible element and said at least one sleeve are coiled within the low overcurrent section between the partition terminal and the second end terminal.

23. The high voltage current limiting fuse of claim 20, in which said casing is tubular.

24. The high voltage current limiting fuse of claim 20, in which said at least one fusible element comprises silver ribbon or wire.

25. The high voltage current limiting fuse of claim 20, in which said at least one sleeve comprises at least one of polytetrafluoroethylene and fluoroethylene polymer.

26. The high voltage current limiting fuse of claim 20, in which said fuse further comprises at least one of a gas-evolving material and polytetrafluoroethylene powder disposed within or compounded into said sleeve.

27. The high voltage current limiting fuse of claim 20, in which said fuse further comprises an M-effect overlay disposed on a selected portion of said at least one fusible element within the sleeve in the low overcurrent section.

28. The high voltage current limiting fuse of claim 20, in which the pulverulent arc-quenching flier comprises sand in both the short circuit and low overcurrent sections.

29. The high voltage current limiting fuse of claim 20, in which said at least one fusible element in the short circuit section comprises a plurality of fusible elements helically wound between said first end terminal and partition terminal in a parallel-connected spaced relationship.

30. A high voltage current limiting fuse, which comprises:

an elongated casing of electrically insulative material having an interior cavity;

a pair of electrically conductive end terminals closing each of the opposite ends of said casing;

an electrically conductive partition terminal connected to the inside walls of the casing, said partition terminal being disposed at a distance along the length of the casing and extending across said casing, dividing said interior cavity of said casing into two electrically series-connected sections, a short circuit section and a low overcurrent section;

the short circuit section comprising at least one elongated fusible element of electrically conductive material disposed within said casing and electrically connected between the first end terminal and the partition terminal, and a pulverulent arc-quenching filler of electrically insulative material within said casing generally surrounding said at least one fusible element in said short circuit section; and, the low overcurrent section comprising an elongated block of insulative material having a plurality of channels extending through the length thereof and disposed within said casing between the second end terminal and the partition terminal, and at least one elongated fusible element of electrically conductive material threaded within said channels of said block and electrically connected between the second end terminal and the partition terminal.

31. The high voltage current limiting fuse of claim 30, in which the casing is tubular.

32. The high voltage current limiting fuse of claim 30, in which the fusible element comprises silver ribbon or wire.

33. The high voltage current limiting fuse of claim 30, in which the respective opposite ends of the block are sealed with an adhesive.

34. The high voltage current limiting fuse of claim 33, in which the adhesive sealing the respective opposite ends of the block is secured to the block with an adhesive bolt disposed within a channel in said block.

35. The high voltage current limiting fuse of claim 30, in which the fuse further comprises insulative material disposed between said partition terminal and said inside wails of said casing.

36. The high voltage current limiting fuse of claim 30, in which the low overcurrent section further comprises at least one of a gas-evolving material and polytetrafluoroethylene powder disposed within said channels and around said fusible element threaded within said channels.

37. The high voltage current limiting fuse of claim 30, in which said low overcurrent section further comprises at least one elongated sleeve of electrically insulative material having an interior cavity spaced around a portion of said at least one fusible element extending within the channels.

38. The high voltage current limiting fuse of claim 37, in which said at least one sleeve in the low overcurrent section further comprises a pair of gas-permeable, pulverulent-tight, seals closing each of the opposite ends of said sleeve, said seals being formed by at least one of melt crimping respective opposite ends of said sleeve together with said fusible element, heat shrinking each of the opposite ends of said sleeve over said fusible element, and taping the opposite ends of said sleeve to the fusible element, and a pulverulent arc-quenching filler of electrically insulative material within said casing generally surrounding said block, said at least one fusible element and said at least one sleeve in the low overcurrent section.

39. The high voltage current limiting fuse of claim 37, in which said sleeve comprises at least one of polytetrafluoroethylene and fluoroethylene polymer.

40. The high voltage current limiting fuse of claim 37, in which said at least one fusible element in the short circuit section comprises a plurality of fusible elements helically wound between said first end terminal and partition terminal in a parallel-connected spaced relationship, and in which said at least one fusible element in the low overcurrent section comprises a plurality of parallel-connected spaced fusible elements threaded within the channels of said block, each fusible element in the low overcurrent section being surrounded by a sleeve within said channels.

41. The high voltage current limiting fuse of claim 37, in which said fuse further comprises at least one of a gas-evolving material and polytetrafluoroethylene powder disposed within or compounded into said at least one sleeve in the low overcurrent section.

* * * * *